US008517688B2

(12) United States Patent
Joshi et al.

(10) Patent No.: US 8,517,688 B2
(45) Date of Patent: Aug. 27, 2013

(54) ROTOR ASSEMBLY FOR USE IN TURBINE ENGINES AND METHODS FOR ASSEMBLING SAME

(75) Inventors: Manish Joshi, Bangalore (IN); Rajarajan Rathina, Bangalore (IN)

(73) Assignee: General Electric Company, Schenectady, NY (US)

( * ) Notice: Subject to any disclaimer, the term of this patent is extended or adjusted under 35 U.S.C. 154(b) by 493 days.

(21) Appl. No.: 12/887,322

(22) Filed: Sep. 21, 2010

(65) Prior Publication Data

US 2012/0067063 A1 Mar. 22, 2012

(51) Int. Cl.
*F01D 5/30* (2006.01)
*F03B 3/12* (2006.01)

(52) U.S. Cl.
USPC ..... 416/218; 416/500

(58) Field of Classification Search
USPC ..... 416/204 R, 219 R, 220 R, 500, 217, 416/218; 415/209.3
See application file for complete search history.

(56) References Cited

U.S. PATENT DOCUMENTS

| | | | | | |
|---|---|---|---|---|---|
| 941,375 | A | * | 11/1909 | Loud et al. | 416/220 R |
| 2,833,515 | A | * | 5/1958 | Newcomb | 416/140 |
| 4,022,545 | A | * | 5/1977 | Shank | 416/221 |
| 4,477,226 | A | * | 10/1984 | Carreno | 416/144 |
| 5,308,227 | A | | 5/1994 | Gros et al. | |
| 5,431,543 | A | * | 7/1995 | Brown et al. | 416/221 |
| 5,860,787 | A | * | 1/1999 | Richards | 416/220 R |
| 6,761,537 | B1 | | 7/2004 | Shapiro et al. | |
| 6,761,538 | B2 | | 7/2004 | Fitts et al. | |
| 7,186,074 | B2 | | 3/2007 | Blatchford et al. | |
| 7,387,486 | B2 | | 6/2008 | Blatchford et al. | |
| 7,390,160 | B2 | | 6/2008 | Blatchford et al. | |
| 2008/0193290 | A1 | * | 8/2008 | Brackett et al. | 415/209.3 |
| 2010/0061859 | A1 | * | 3/2010 | DeMania et al. | 416/219 R |

* cited by examiner

*Primary Examiner* — Edward Look
*Assistant Examiner* — William Grigos
(74) *Attorney, Agent, or Firm* — Armstrong Teasdale LLP

(57) ABSTRACT

A rotor assembly for use with a turbine engine. The rotor assembly includes at least one rotor disk that includes an inner surface that defines a dovetail groove. At least one turbine bucket is coupled to the rotor disk. The turbine bucket includes an airfoil that extends outwardly from a dovetail. The dovetail is inserted at least partially within the dovetail groove. A tang assembly extends from one of the inner surface of the rotor disk and the dovetail. the tang assembly minimizes a rotation of the turbine bucket with respect to the rotor disk.

19 Claims, 7 Drawing Sheets

ROTOR ASSEMBLY FOR USE IN TURBINE ENGINES AND METHODS FOR ASSEMBLING SAME

BACKGROUND OF THE INVENTION

The subject matter described herein relates generally to turbine engines and, more particularly, to a rotor assembly for use with steam turbine engines.

At least some known steam turbines have a defined steam path that includes, in serial-flow relationship, an inlet, a turbine, and an outlet. Known steam turbines also include a plurality of stationary diaphragms that direct a flow of steam towards a rotor assembly. At least some known rotor assemblies include at least one row of turbine buckets that are circumferentially-spaced about a rotor disk. Steam channeled to the rotor assembly from the diaphragm assembly impacts the turbine buckets to induce rotation of the rotor assembly.

At least some known turbine buckets include an airfoil that extends radially outwardly from a dovetail. The dovetail is used to couple the turbine bucket to a rotor disk or spool. Known rotor disks include a dovetail groove that is defined within the rotor disk and that is sized and shaped to receive the dovetail therein. To facilitate assembly of the rotor assembly, at least some known dovetail grooves are sized larger than the turbine bucket. During operation, as steam is channeled towards the rotor assembly, the dovetail may undesirably rotate or shift within the dovetail groove. Over time, movement of the dovetail within the dovetail groove may increase an amount of wear between the dovetail and the dovetail groove and may result in damage to the turbine bucket and/or the rotor disk, and/or may lessen a useful life of a portion of the rotor assembly.

BRIEF SUMMARY OF THE INVENTION

In one aspect, a rotor assembly for use with a turbine engine is provided. The rotor assembly includes at least one rotor disk that includes an inner surface that defines a dovetail groove. At least one turbine bucket is coupled to the rotor disk. The turbine bucket includes an airfoil that extends outwardly from a dovetail. The dovetail is inserted at least partially within the dovetail groove. A tang assembly extends from one of the inner surface of the rotor disk and the dovetail. the tang assembly minimizes a rotation of the turbine bucket with respect to the rotor disk.

In another aspect, a turbine engine is provided. The turbine engine includes a generator, a turbine that is coupled to the generator, and a rotor assembly that extends axially through the turbine. The rotor assembly includes at least one rotor disk that includes an inner surface that defines a dovetail groove. At least one turbine bucket is coupled to the rotor disk. The turbine bucket includes an airfoil that extends outwardly from a dovetail. The dovetail is inserted at least partially within the dovetail groove. A tang assembly extends from one of the inner surface of the rotor disk and the dovetail. the tang assembly minimizes a rotation of the turbine bucket with respect to the rotor disk.

In a further aspect, a method for assembling a rotor assembly for use with a turbine engine is provided. The method includes providing at least one rotor disk that includes a dovetail groove defined by an inner surface, a first axial surface, and a second axial surface. The inner surface extends generally axially between the first axial surface and the second axial surface. A tang assembly is defined within the dovetail groove. The tang assembly extends from one of the inner surface, the first axial surface, and the second axial surface. A turbine bucket including an airfoil and a dovetail is provided. The turbine bucket is coupled to the rotor disk such that the tang assembly is between the turbine bucket and the rotor disk to minimize rotation of the turbine bucket with respect to the rotor disk.

DETAILED DESCRIPTION OF THE INVENTION

The exemplary apparatus and methods described herein overcome disadvantages of known turbine bucket assemblies by providing a turbine bucket that may be more securely coupled to the rotor shaft than is generally available using known turbine buckets. More specifically, the embodiments of turbine buckets described herein each include a tang assembly that extends at least partially between the turbine bucket and a rotor disk to facilitate preventing rotation of the turbine bucket with respect to a rotor disk.

As used herein, the term "turbine bucket" is used interchangeably with the term "bucket" and thus can include any combination of a bucket that includes a platform and a dovetail, and/or a bucket that is integrally formed with a rotor disk, either embodiment of which may include at least one airfoil segment.

Figure 1:
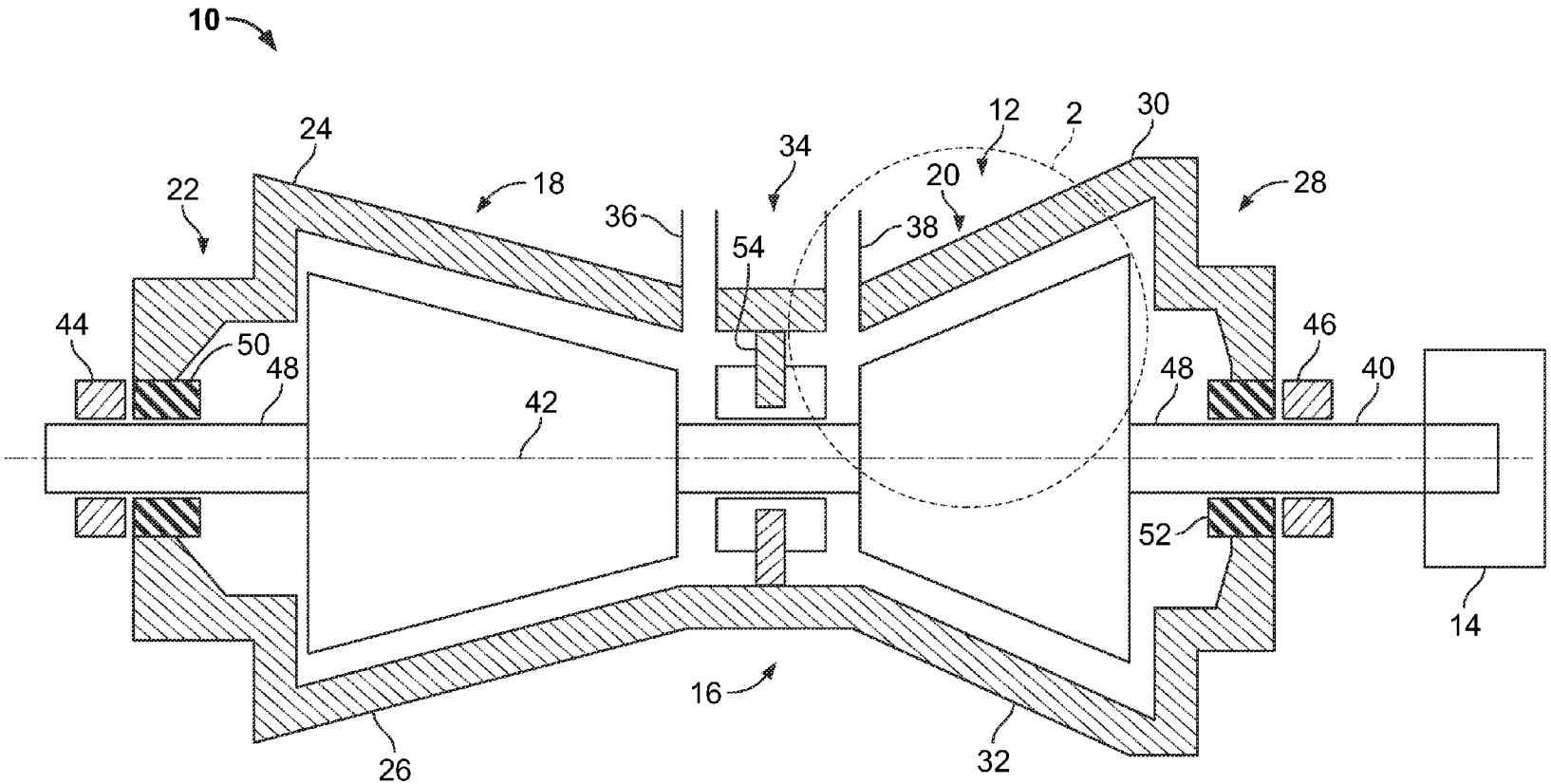
FIG. 1 is a schematic view of an exemplary steam turbine engine.

FIG. 1 is a schematic view of an exemplary turbine engine 10. In the exemplary embodiment, turbine engine 10 is an opposed-flow high pressure and intermediate pressure steam turbine combination. Alternatively, turbine engine 10 may be any type of steam turbine for example, without limitation, a low pressure turbine, a single-flow steam turbine, and/or a double-flow steam turbine. In the exemplary embodiment, turbine engine 10 includes a turbine 12 that is coupled to a generator 14 via a rotor assembly 16. Moreover, in the exemplary embodiment, turbine 12 includes a high pressure (HP) section 18 and an intermediate pressure (IP) section 20. An HP casing 22 is divided axially into upper and lower half sections 24 and 26, respectively. Similarly, an IP casing 28 is divided axially into upper and lower half sections 30 and 32, respectively. A central section 34 extends between HP section 18 and IP section 20, and includes an HP steam inlet 36 and an IP steam inlet 38. Rotor assembly 16 extends between HP section 18 and IP section 20 and includes a rotor shaft 40 that extends along a centerline axis 42 between HP section 18 and IP section 20. Rotor shaft 40 is supported from casing 22 and 28 by journal bearings 44 and 46, respectively, that are each coupled to opposite end portions 48 of rotor shaft 40. Steam seal units 50 and 52 are coupled between rotor shaft end portions 48 and casings 22 and 28 to facilitate sealing HP section 18 and IP section 20.

An annular divider 54 extends radially inwardly between HP section 18 and IP section 20 from central section 34 towards rotor assembly 16. More specifically, divider 54 extends circumferentially about rotor assembly 16 between HP steam inlet 36 and IP steam inlet 38.

During operation, steam is channeled to turbine 12 from a steam source, for example, a power boiler (not shown), wherein steam thermal energy is converted to mechanical rotational energy by turbine 12, and subsequently electrical energy by generator 14. More specifically, steam is channeled through HP section 18 from HP steam inlet 36 to impact rotor assembly 16 positioned within HP section 18 and to induce rotation of rotor assembly 16 about axis 42. Steam exits HP section 18 and is channeled to a boiler (not shown) that increases a temperature of the steam to a temperature that is approximately equal to a temperature of steam entering HP section 18. Steam is then channeled to IP steam inlet 38 and to IP section 20 at a reduced pressure than a pressure of the steam entering HP section 18. The steam impacts the rotor assembly 16 that is positioned within IP section 20 to induce rotation of rotor assembly 16.

Figure 2:
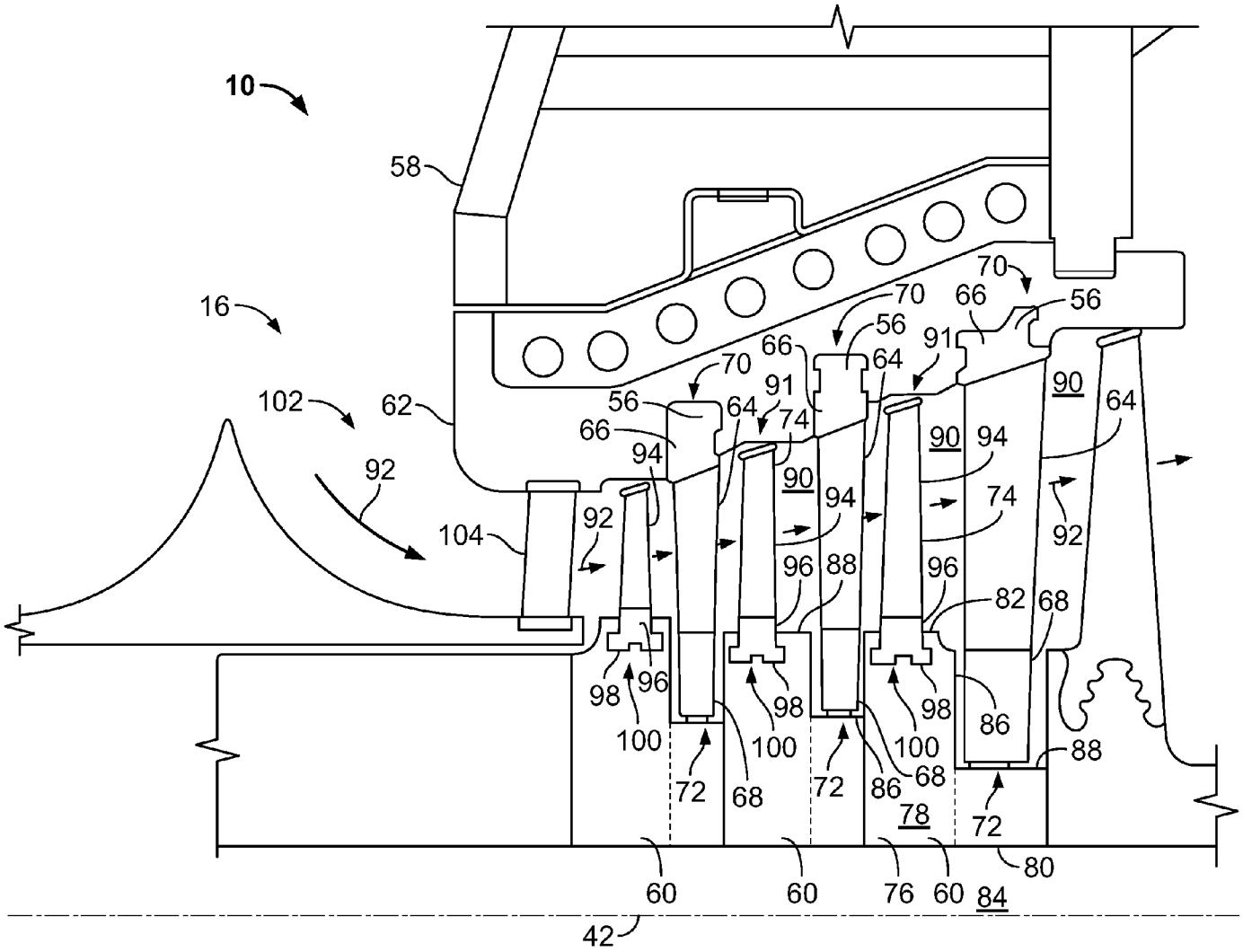
FIG. 2 is a schematic view of a portion of the steam turbine engine shown in FIG. 1 and taken along area 2.

FIG. 2 is a schematic view of a portion of turbine engine 10 taken along area 2. In the exemplary embodiment, turbine engine 10 includes rotor assembly 16, a plurality of stationary diaphragm assemblies 56, and a casing 58 that extends circumferentially about rotor assembly 16 and diaphragm assemblies 56. Rotor assembly 16 includes a plurality of rotor disk assemblies 60 that are each aligned substantially axially between each adjacent pair of diaphragm assembly 56. Each diaphragm assembly 56 is securely coupled to casing 58. More specifically, casing 58 includes a nozzle carrier 62 that extends radially inwardly from casing 58 towards rotor assembly 16. Each diaphragm assembly 56 is coupled to nozzle carrier 62 to facilitate preventing a rotation of diaphragm assembly 56 with respect to rotor assembly 16. Each diaphragm assembly 56 includes a plurality of circumferentially-spaced nozzles 64 that extend between a radially outer portion 66 and a radially inner portion 68. Radially outer portion 66 is positioned within a recessed portion 70 defined within nozzle carrier 62 to facilitate coupling diaphragm assembly 56 to nozzle carrier 62. Radially inner portion 68 is positioned adjacent to rotor disk assembly 60. In one embodiment, inner portion 68 includes a plurality of sealing assemblies 72 that form a tortuous sealing path between diaphragm assembly 56 and rotor disk assembly 60.

In the exemplary embodiment, each rotor disk assembly 60 includes a plurality of turbine buckets 74 that are each coupled to a rotor disk 76. Rotor disk 76 includes a disk body 78 that extends between a radially inner portion 80 and a radially outer portion 82. Radially inner portion 80 defines a central bore 84 that extends generally axially through rotor disk 76 such that disk body 78 extends radially outwardly from central bore 84. Disk body 78 extends generally axially between an upstream member 86 to an opposite downstream member 88. Rotor disk 76 is coupled to an adjacent rotor disk 76 such that upstream member 86 is coupled to an adjacent downstream member 88.

Each turbine bucket 74 is coupled to outer portion 82 of rotor disk 76 and is circumferentially-spaced about rotor disk 76. Each turbine bucket 74 extends radially outwardly from rotor disk 76 towards casing 58. Adjacent rotor disks 76 are coupled together such that a gap 90 is defined between each adjacent row 91 of circumferentially-spaced turbine buckets 74. Nozzles 64 are spaced circumferentially about each rotor disk 76 between adjacent rows 91 of turbine buckets 74 to channel steam towards turbine buckets 74. A steam flow path 92 is defined between turbine casing 58 and each rotor disk 76.

In the exemplary embodiment, each turbine bucket 74 is coupled to an outer portion 82 of a respective rotor disk 76 such that each turbine bucket 74 extends into steam flow path 92. More specifically, each turbine bucket 74 includes an airfoil 94 that extends radially outwardly from a dovetail 96. Dovetail 96 is inserted into a dovetail groove 98 defined within an outer portion 82 of rotor disk 76 to enable turbine bucket 74 to be coupled to rotor disk 76. A tang assembly 100 extends between dovetail 96 and dovetail groove 98 to securely couple turbine bucket 74 to rotor disk 76.

During operation of turbine engine 10, steam is channeled into turbine 12 through a steam inlet 102 and into steam flow path 92. Each inlet nozzle 104 and diaphragm assemblies 56 channel the steam towards turbine buckets 74. As steam impacts each turbine bucket 74, turbine bucket 74 and rotor disk 76 are rotated circumferentially about axis 42. Tang assembly 100 minimizes rotation of turbine bucket 74 with respect to rotor disk 76, such that thermal energy in the steam is efficiently converted into rotation of rotor assembly 16. More specifically, tang assembly 100 also facilitates mitigating losses of mechanical rotational energy by preventing non-circumferential rotation of turbine bucket 74 within dovetail groove 98.

Figure 3:
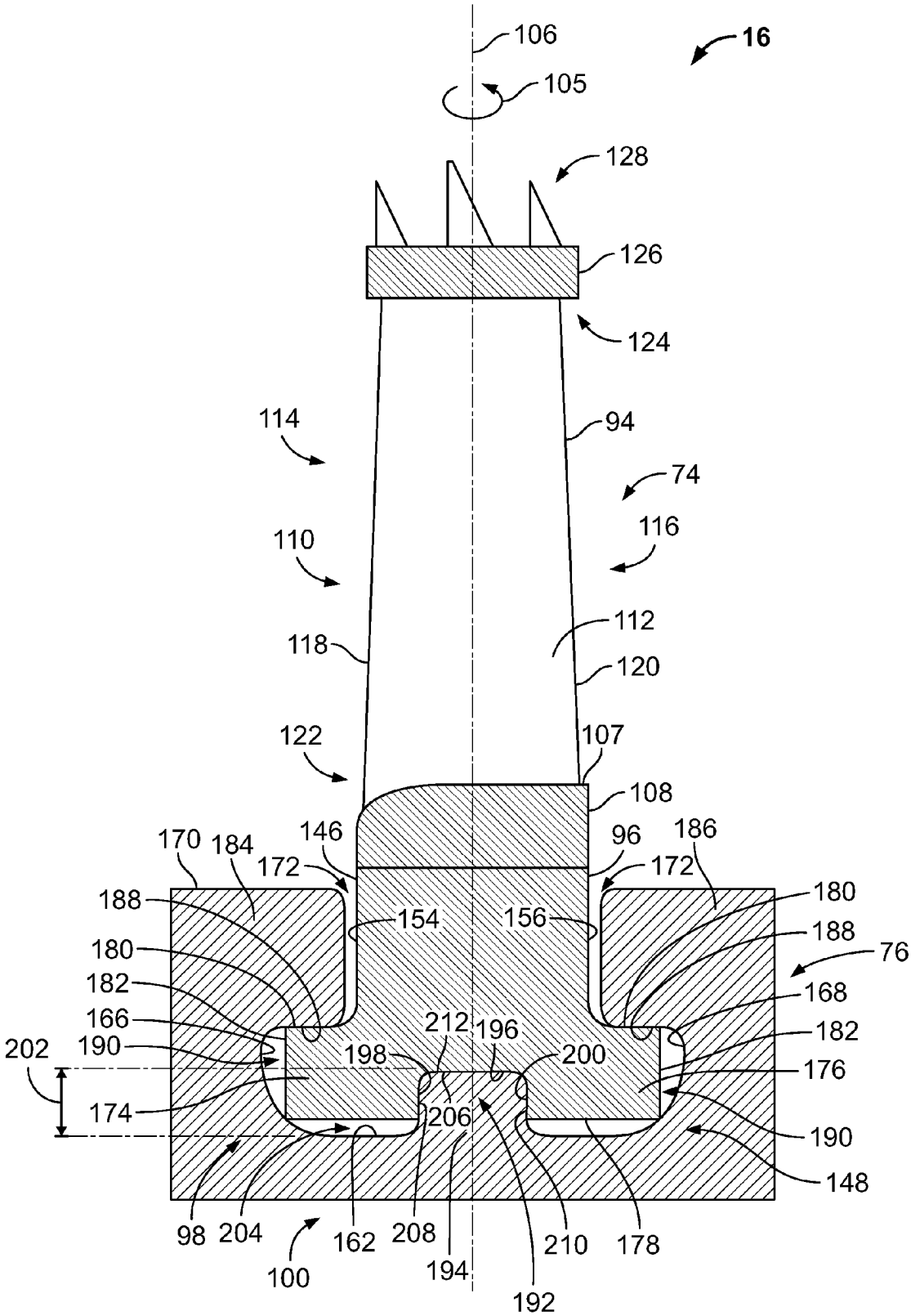
FIG. 3 is an enlarged sectional view of an exemplary rotor assembly that may be used with the turbine engine shown in FIG. 1.
Figure 4:
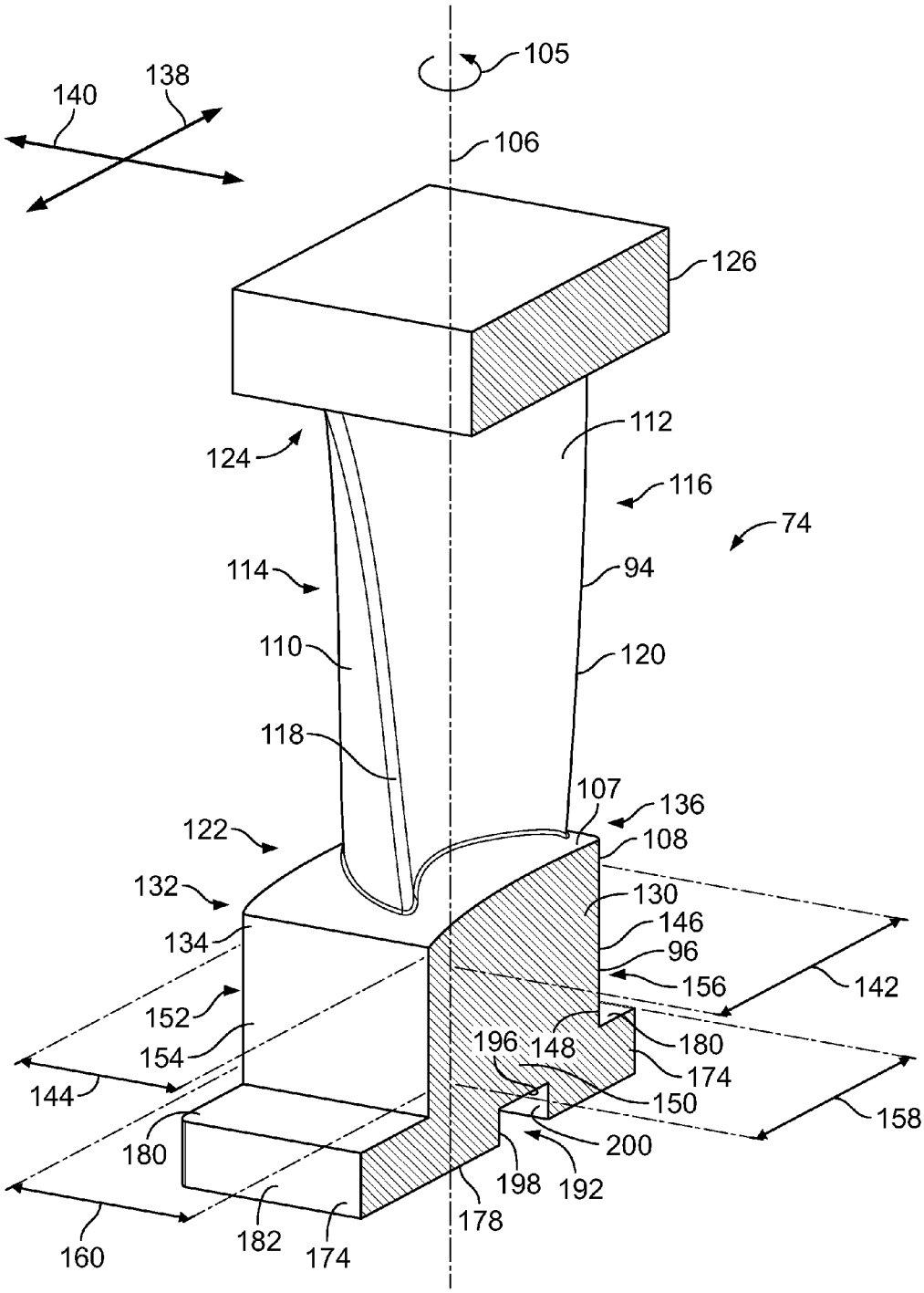
FIG. 4 is a perspective view of the exemplary turbine bucket shown in FIG. 3.

FIG. 3 is an enlarged sectional view of an exemplary rotor assembly 16 that may be used with turbine engine 10 (shown in FIG. 1). FIG. 4 is a perspective view of an exemplary turbine bucket 74. Identical components shown in FIG. 3 and FIG. 4 are labeled with the same reference numbers used in FIG. 2. In the exemplary embodiment, rotor assembly 16 includes at least one turbine bucket 74 that is coupled to at least one rotor disk 76, and a tang assembly 100 that extends between turbine bucket 74 and rotor disk 76. Tang assembly 100 is sized, shaped, and oriented to facilitate preventing rotation (represented by arrow 105) of turbine bucket 74 with respect to rotor disk 76 about a radial axis 106 defined by turbine bucket 74. More specifically, tang 100 prevents rotation of turbine bucket 74 within dovetail groove 98.

In the exemplary embodiment, turbine bucket 74 includes airfoil 94, a platform 107, a shank 108, and dovetail 96. Each airfoil 94 includes a first sidewall 110 and an opposite second sidewall 112. In the exemplary embodiment, first sidewall 110 is convex and defines a suction side 114 of airfoil 94, and second sidewall 112 is concave and defines a pressure side 116 of airfoil 94. First sidewall 110 is coupled to second sidewall 112 along a leading edge 118 and along an axially-spaced trailing edge 120. More specifically, airfoil trailing edge 120 is spaced chord-wise and downstream from airfoil leading edge 118. First sidewall 110 and second sidewall 112 each extend radially outwardly from a blade root 122 towards an airfoil tip 124. Blade root 122 extends from platform 107. In the exemplary embodiment, a tip cover 126 is coupled to airfoil tip 124 adjacent to nozzle carrier 62. More specifically, in the exemplary embodiment, tip cover 126 includes a plurality of sealing assemblies 128 that form a tortuous sealing path between nozzle carrier 62 and turbine bucket 74.

Platform 107 extends between airfoil 94 and shank 108 such that each airfoil 94 extends radially outwardly from platform 107. Shank 108 extends radially inwardly from platform 107 to dovetail 96. Dovetail 96 extends radially inwardly from shank 108 towards rotor disk 76 for use in coupling turbine buckets 74 to rotor disk 76.

In the exemplary embodiment, each shank 108 includes a pair of circumferentially-spaced sides 130 and 132 that are coupled together by an upstream face 134 and a downstream face 136. In the exemplary embodiment, sides 130 and 132 are identical and are oriented substantially parallel to each other. Alternatively, sides 130 and 132 are oriented at an oblique angle. In the exemplary embodiment, sides 130 and 132 each extend in an axial direction 138. Upstream face 134 and downstream face 136 are substantially parallel to each other and each extend in a circumferential direction 140 that is substantially perpendicular to axial direction 138. In the exemplary embodiment, shank 108 has an axial width 142 measured from upstream face 134 to downstream face 136, and a circumferential length 144 measured between sides 130 and 132.

Dovetail 96 includes an upper portion 146 and a lower portion 148. Upper portion 146 extends between shank 108 and lower portion 148. Upper portion 146 and lower portion 148 each include a first sidewall 150, a second sidewall 152, an upstream surface 154, and an opposite downstream surface 156. First sidewall 150 and second sidewall 152 each extend in axial direction 138. Upstream surface 154 and downstream surface 156 each extend in circumferential direction 140. First sidewall 150 is coupled between upstream surface 154 and downstream surface 156 such that upstream surface 154 is opposite downstream surface 156. Second sidewall 152 is spaced circumferentially from first sidewall 150 and extends between upstream surface 154 and downstream surface 156. In one embodiment, first sidewall 150 is coupled to second sidewall 152 to form a unitary member that extends between upstream surface 154 and downstream surface 156.

Upper portion 146 includes an axial width 158 measured between upstream surface 154 and downstream surface 156. Upper portion 146 also includes a circumferential length 160 measured between first sidewall 150 and second sidewall 152. In the exemplary embodiment, upper portion axial width 158 is approximately the same size as shank axial width 142, and upper portion circumferential length 160 is approximately the same size as shank circumferential length 144. Alternatively, axial width 158 may be different than axial width 142, and/or circumferential length 160 may be different than circumferential length 144.

In the exemplary embodiment, dovetail groove 98 is defined by an interior surface 162 that extends axially between a first axial inner surface 166 and a second axial inner surface 168. First and second axial surfaces 166 and 168 extend radially inwardly from an outer surface 170 of rotor disk 76 to interior surface 162.

In one embodiment, dovetail 96 is positioned within dovetail groove 98 such that a gap 172 is defined between upstream and downstream surfaces 154 and 156 and between first and second axial inner surfaces 166 and 168. Gap 172 facilitates thermal expansion of turbine bucket 74 during operation of turbine engine 10.

In the exemplary embodiment, lower portion 148 includes a first bearing hook 174 and an opposite second bearing hook 176. Each bearing hook 174 and 176 facilitates preventing turbine bucket 74 from moving radially outwardly with respect to rotor disk 76. More specifically, first bearing hook 174 extends outwardly from upstream surface 154 towards first axial inner surface 166 of rotor disk 76 in axial direction 138, and second bearing hook 176 extends outwardly from downstream surface 156 towards second axial inner surface 168 in axial direction 138 that is opposite first bearing hook 174. Bearing hooks 174 and 176 each extend outwardly from upstream surface 154 and downstream surface 156, respectively, and each is adjacent to a radially outer surface 178 of lower portion 148. Bearing hooks 174 and 176 each include an upper bearing surface 180 and an axially outer surface 182. Each upper bearing surface 180 is configured to engage rotor disk 76 to facilitate securing turbine bucket 74 to rotor disk 76.

Rotor disk 76 includes a pair of bearing flanges 184 and 186 that extend inwardly from each axial inner surface 166 and 168, respectively. In the exemplary embodiment, bearing hooks 174 and 176 each engage respective bearing flanges 184 and 186 to facilitate securely coupling turbine bucket 74 to rotor disk 76. Each bearing flange 184 and 186 has a radial bearing surface 188. Bearing hooks 174 and 176 are each positioned adjacent to respective bearing flanges 184 and 186 such that upper bearing surfaces 180 contact radial bearing surfaces 188. In one embodiment, dovetail groove 98 is sized and oriented such that a gap 190 is defined between first and second axial inner surfaces 166 and 168 and outer surfaces 182 of respective bearing hooks 174 and 176.

In the exemplary embodiment, tang assembly 100 is formed with a recessed groove 192 and a radial flange 194. More specifically, groove 192 is defined in radially outer surface 178 of lower portion 148 and is sized and shaped to receive radial flange 194 therein. In the exemplary embodiment, dovetail 96 is inserted into dovetail groove 98 such that radial flange 194 is received within groove 192. Radial flange 194 is coupled to rotor disk 76 and extends radially outwardly from interior surface 162 of rotor disk 76 towards dovetail 96. Groove 192 is defined by an inner radial surface 196 that extends between a first axial surface 198 and a second axial surface 200. First and second axial surfaces 198 and 200 each extend radially outwardly from outer surface 178 towards upper portion 146. First axial surface 198 is oriented substantially parallel to second axial surface 200. Groove 192 extends circumferentially between first sidewall 150 and second sidewall 152, and is oriented substantially parallel to upstream surface 154. Alternatively, groove 192 extends axially between upstream surface 154 and downstream surface 156. In the exemplary embodiment, groove 192 also has a radial height 202 such that a gap 204 is defined between outer surface 178 and interior surface 162 when radial flange 194 is inserted into groove 192.

In the exemplary embodiment, radial flange 194 includes a radially outer surface 206 that extends between a first axial sidewall 208 and a second axial sidewall 210. More specifically, radial flange 194 extends circumferentially along interior surface 162 and along at least a portion of dovetail circumferential length 160. In one embodiment, radial flange 194 extends continuously about rotor disk 76. In the exemplary embodiment, radial flange 194 is inserted within groove 192 such that first and second axial sidewalls 208 and 210 contact first and second axial surfaces 198 and 200, respectively. Moreover, first and second axial sidewalls 208 and 210 contact first and second axial surfaces 198 and 200 in a friction fit.

In the exemplary embodiment, a shim 212 is inserted between radial flange 194 and groove 192 to bias turbine bucket 74 radially outwardly from rotor disk 76 towards steam flow path 92. More specifically, in the exemplary embodiment, shim 212 is positioned between inner radial surface 196 and radial outer surface 206 to bias turbine bucket 74 to facilitate first and second bearing hooks 174 and 176 engaging bearing flanges 184 and 186, respectively.

Figure 5:
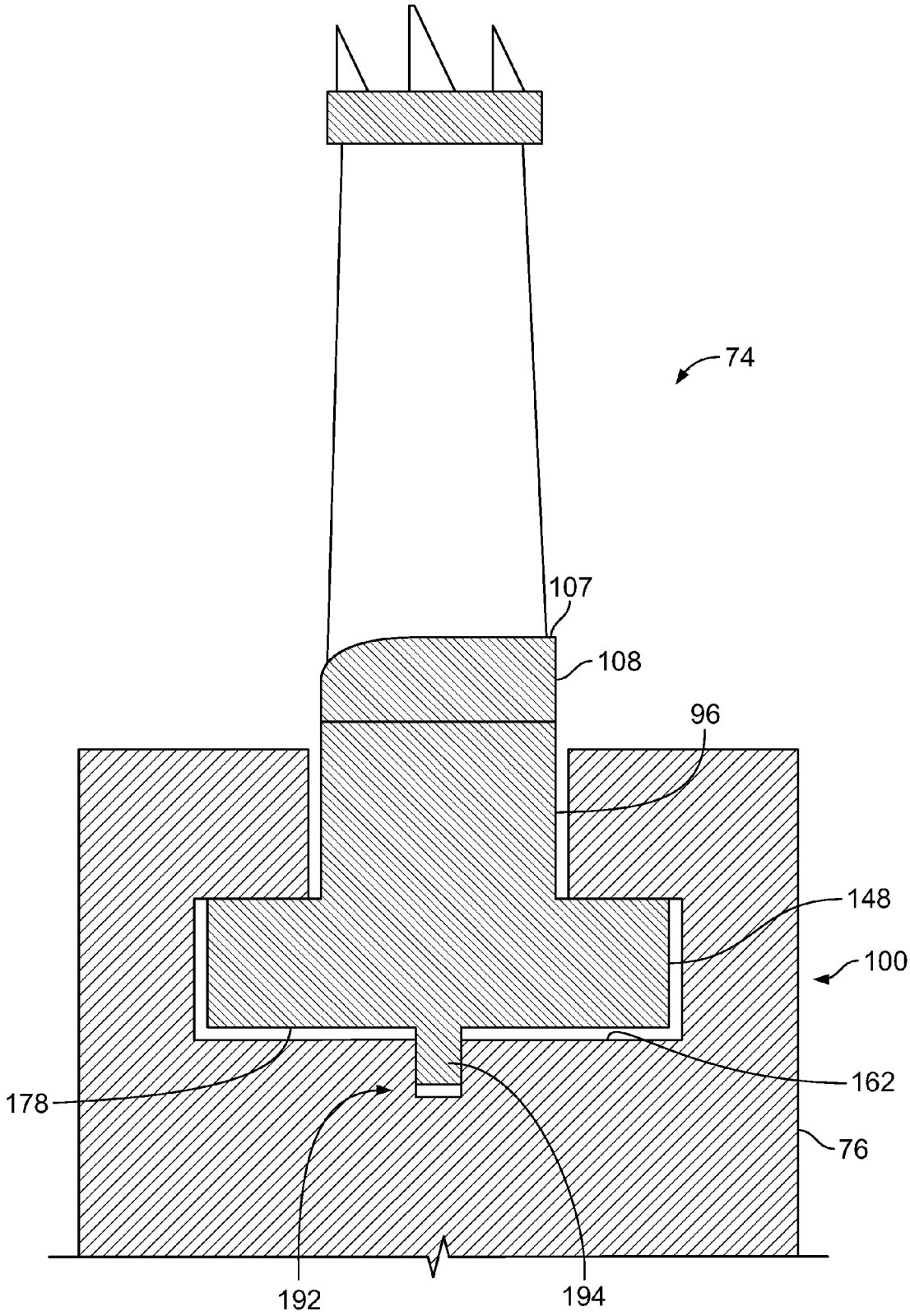
FIGS. 5-7 are enlarged sectional views of alternative embodiments of the rotor assembly shown in FIG. 3.
Figure 6:
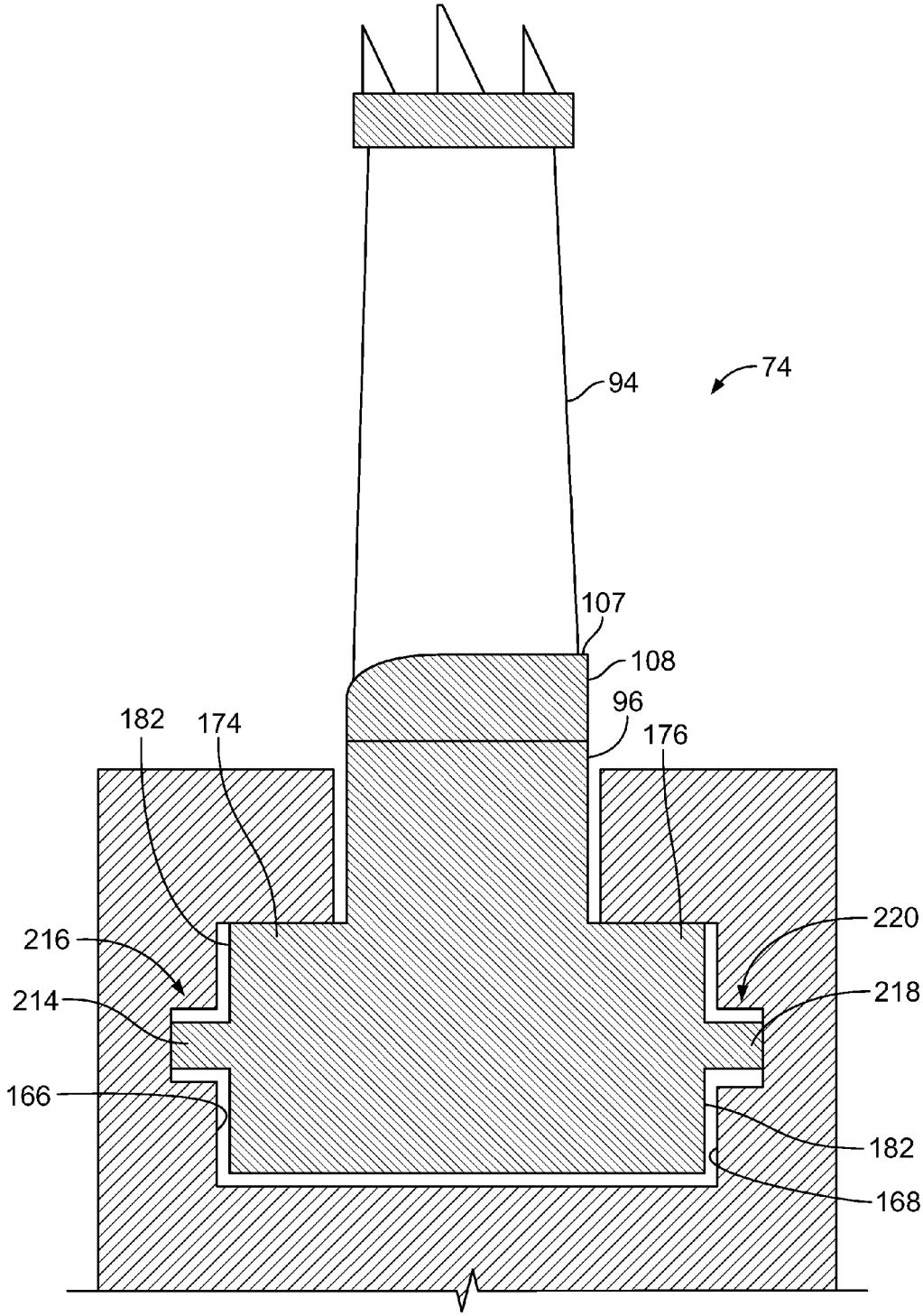
Figure 7:
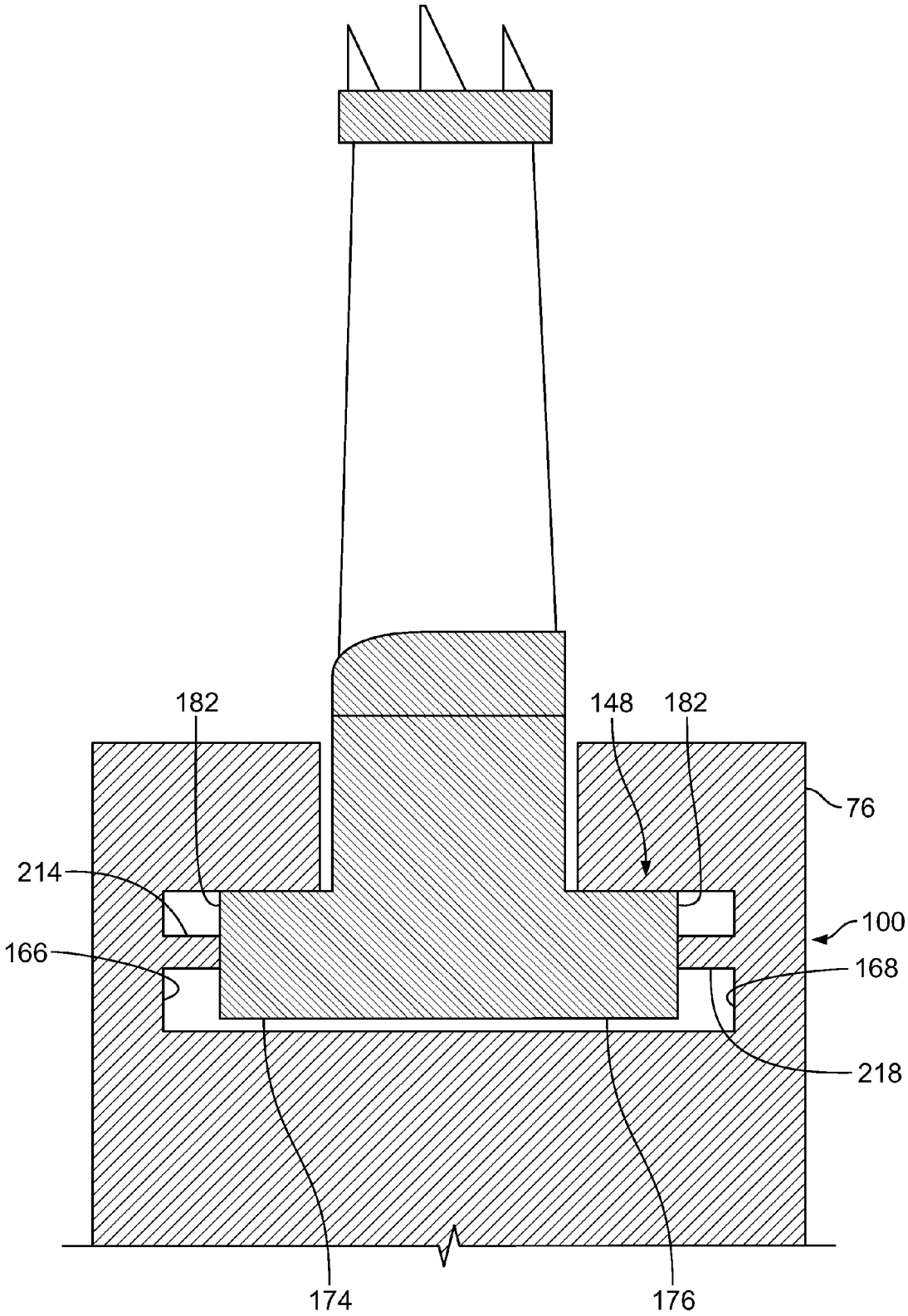

FIGS. 5-7 are enlarged sectional views of alternative embodiments of tang assembly 100. Identical components shown in FIGS. 5-7 are labeled with the same reference numbers used in FIG. 4. Referring to FIG. 5, in the exemplary embodiment illustrated, radial flange 194 extends from dovetail 96 and more specifically, extends inwardly from outer surface 178 of lower portion 148 towards rotor disk 76. Rotor disk 76 includes a recessed groove 192 defined by interior surface 162. Groove 192 is sized, shaped, and oriented to receive radial flange 194 such that tang assembly 100 minimizes rotation of turbine bucket 74 with respect to rotor disk 76 within groove 192.

Referring to FIG. 6, in another embodiment, tang assembly 100 includes a first axial flange 214 positioned within a first recessed groove 216 and a second axial flange 218 positioned within a second recessed groove 220. More specifically, first axial flange 214 extends axially outwardly from outer surface 182 of first bearing hook 174 towards first axial inner surface 166. First axial inner surface 166 defines first recessed groove 216 that is sized, shaped, and oriented to receive first axial flange 214. Second axial flange 218 extends axially outwardly from outer surface 182 of second bearing hook 176 towards second axial inner surface 168 opposite first axial flange 214. Second axial inner surface 168 defines second recessed groove 220 that is sized, shaped, and oriented to receive second axial flange 218.

Referring to FIG. 7, in yet another embodiment, tang assembly 100 includes first axial flange 214 and second axial flange 218 that each extend axially inwardly from rotor disk 76 towards lower portion 148. More specifically, first axial flange 214 extends inwardly from first axial inner surface 166 and contacts outer surface 182 of first bearing hook 174. Second axial flange 218 extends inwardly from second axial inner surface 168 and contacts outer surface 182 of second bearing hook 176.

The above-described rotor assembly provides a cost-effective and reliable method for increasing an efficiency in performance of a turbine engine. Moreover, the rotor assembly facilitates increasing the operating efficiency of the overall turbine engine by reducing non-circumferential rotation of turbine buckets. More specifically, the rotor assembly includes a tang assembly that minimizes rotation of the turbine bucket with respect to a rotor disk that may result in increased wear of the turbine bucket. As a result, the tang assembly facilitates extending a useful life of the rotor assembly and facilities improving the operating efficiency of the steam turbine engine. As such, the cost of maintaining the steam turbine engine system is facilitated to be reduced.

Exemplary embodiments of methods and apparatus for a rotor assembly are described above in detail. The methods and apparatus are not limited to the specific embodiments described herein, but rather, components of systems and/or steps of the method may be utilized independently and separately from other components and/or steps described herein. For example, the methods and apparatus may also be used in combination with other rotary engine systems and methods, and are not limited to practice with only the steam turbine engine as described herein. Rather, the exemplary embodiment can be implemented and utilized in connection with many other rotary system applications.

Although specific features of various embodiments of the invention may be shown in some drawings and not in others, this is for convenience only. Moreover, references to "one embodiment" in the above description are not intended to be interpreted as excluding the existence of additional embodiments that also incorporate the recited features. In accordance with the principles of the invention, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A rotor assembly for use with a turbine engine, said rotor assembly comprising:

at least one rotor disk comprising an inner surface defining a dovetail groove;

at least one turbine bucket coupled to said rotor disk, said turbine bucket comprising an airfoil extending outwardly from a dovetail, said dovetail inserted at least partially within said dovetail groove; and a tang assembly extending from one of said inner surface of said rotor disk and said dovetail, said tang assembly minimizes a rotation of said turbine bucket with respect to said rotor disk, wherein said tang assembly comprises:

at least one flange extending outwardly from said dovetail; and a groove defined within said rotor disk, said groove sized to receive said at least one flange therein.

2. A rotor assembly in accordance with claim 1, wherein said tang assembly further comprises:

a radial flange extending radially from said inner surface; and a recessed groove defined within said dovetail, said recessed groove configured to receive said radial flange therein.

3. A rotor assembly in accordance with claim 2, wherein said turbine bucket further comprises a shank extending between said airfoil and said dovetail, said airfoil extending radially outwardly from said shank, said dovetail having a width that is approximately equal to a width of said shank.

4. A rotor assembly in accordance with claim 3, wherein said turbine bucket comprises at least one bearing hook extending outwardly from said dovetail towards said rotor disk inner surface, said bearing hook configured to engage said rotor disk to facilitate preventing a movement of said turbine bucket within said dovetail groove.

5. A rotor assembly in accordance with claim 4, wherein said rotor disk further comprises at least one bearing flange extending inwardly from said inner surface, said bearing flange configured to contact said bearing hook to facilitate preventing a movement of said turbine bucket.

6. A rotor assembly in accordance with claim 5, further comprising a shim positioned between said radial flange and said dovetail for biasing said dovetail such that said bearing hook contacts said bearing flange.

7. A rotor assembly in accordance with claim 1, wherein said tang assembly further comprises:

a radial flange extending radially from said dovetail; and a recessed groove defined within said rotor disk, said recessed groove configured to receive said radial flange therein.

8. A rotor assembly in accordance with claim 1, wherein said tang assembly further comprises:

at least one axial flange extending inwardly from said rotor disk towards said dovetail lower portion; said axial flange configured to contact an outer surface of said lower portion.

9. A turbine engine comprising:

a generator;

a turbine coupled to said generator; and a rotor assembly extending through said turbine, said rotor assembly comprising:

at least one rotor disk comprising an inner surface defining a dovetail groove;

at least one turbine bucket coupled to said rotor disk, said turbine bucket comprising an airfoil extending outwardly from a dovetail, said dovetail inserted at least partially within said dovetail groove; and a tang assembly extending from one of said inner surface of said rotor disk and said dovetail, said tang assembly minimizes a rotation of said turbine bucket with respect to said rotor disk, wherein said tang assembly comprises:

at least one flange extending outwardly from said dovetail; and a groove defined within said rotor disk, said groove sized to receive said at least one flange therein.

10. A turbine engine in accordance with claim 9, wherein said tang assembly further comprises:

a radial flange extending radially from said inner surface; and a recessed groove defined within said dovetail, said recessed groove configured to receive said radial flange therein.

11. A turbine engine in accordance with claim 10, wherein said turbine bucket further comprises a shank extending between said airfoil and said dovetail, said airfoil extending radially outwardly from said shank, said dovetail having a width that is approximately equal to a width of said shank.

12. A turbine engine in accordance with claim 11, wherein said turbine bucket further comprises at least one bearing hook extending outwardly from said dovetail towards said rotor disk inner surface, said rotor disk comprising at least one bearing flange extending inwardly from said inner surface, said bearing flange configured to contact said bearing hook to facilitate preventing a movement of said turbine bucket within said dovetail groove.

13. A turbine engine in accordance with claim 12, wherein said rotor assembly further comprises a shim positioned between said radial flange and said dovetail.

14. A method for assembling a rotor assembly for use with a turbine engine, said method comprising:

providing at least one rotor disk that includes a dovetail groove defined by an inner surface, a first axial surface, and a second axial surface, the inner surface extending generally axially between the first axial surface and the second axial surface;

defining a tang assembly within the dovetail groove, the tang assembly extending from one of the inner surface, the first axial surface, and the second axial surface; and providing a turbine bucket including an airfoil and a dovetail;

coupling the turbine bucket to the rotor disk such that the tang assembly is between the turbine bucket and the rotor disk to minimize rotation of the turbine bucket with respect to the rotor disk, wherein the tang assembly includes:

at least one flange extending outwardly from the dovetail; and a groove defined within the rotor disk, the groove sized to receive the at least one flange therein.

15. A method in accordance with claim 14, further comprising:

coupling a radial flange to the rotor disk inner surface;

defining a recessed groove within the dovetail, the recessed groove sized to receive the radial flange therein; and coupling the dovetail to the rotor disk such that the radial flange is inserted within the recessed groove to form the tang assembly.

16. A method in accordance with claim 15, further comprising coupling a shank between the airfoil and the dovetail, the shank having a width that is substantially equal to a width of the dovetail.

17. A method in accordance with claim 15, further comprising coupling at least one bearing hook to the dovetail, the bearing hook extending axially outwardly from the dovetail towards one of the first axial surface and the second axial surface, the bearing hook configured to engage the rotor disk to facilitate preventing a radial movement of the turbine bucket.

18. A method in accordance with claim 17, further comprising coupling at least one bearing flange to one of the first axial surface and the second axial surface, the at least one bearing flange configured to contact the at least one bearing hook.

19. A method in accordance with claim 18, further comprising coupling a shim between the radial flange and the dovetail, the shim configured to bias the dovetail radially outwardly such that the bearing hook contacts the bearing flange.

* * * * *